United States Patent [19]

Takahashi

[11] Patent Number: 4,930,321

[45] Date of Patent: Jun. 5, 1990

[54] REFRIGERATED DISPLAY CASE WITH NIGHT COVER

[75] Inventor: Junichi Takahashi, Takasakishi, Japan

[73] Assignee: Sanden Corporation, Gunma, Japan

[21] Appl. No.: 325,531

[22] Filed: Mar. 20, 1989

[30] Foreign Application Priority Data

Mar. 18, 1988 [JP] Japan ..... 63-37042[U]

[51] Int. Cl.[5] ..... A47F 3/04

[52] U.S. Cl. ..... 62/249; 62/256; 150/165; 312/116

[58] Field of Search ..... 62/246, 248, 249, 251, 62/255, 256; 312/116; 150/165, 154, 901

[56] References Cited

U.S. PATENT DOCUMENTS

| | | | |
|---|---|---|---|
| 3,186,185 | 6/1965 | Bently et al. | 62/255 |
| 3,597,036 | 8/1971 | Buffington | 312/116 X |
| 3,759,059 | 9/1973 | Kenyon | 62/255 X |
| 4,288,992 | 9/1981 | Eliason | 62/256 |
| 4,400,046 | 8/1983 | Karashima | 312/116 X |
| 4,424,685 | 1/1984 | Ibrahim | 62/249 |

*Primary Examiner*—Lloyd L. King

*Attorney, Agent, or Firm*—Banner, Birch, McKie & Beckett

[57] ABSTRACT

A refrigerated display case includes a cabinet having a top opening, at least one. A sliding door move to cover and uncover the opening, and a night cover. The night cover can be stored inside the cabinet and pulled out to cover at least one of the sliding doors at night. A spacing member is disposed on the trailing edge of the door frame and keeps the night cover from sagging and contacting the door. Therefore, the sliding door can be opened and closed easily since friction between the sliding door and the night cover is eliminated by the spacing member. Furthermore, the weight, structure, and external appearance of the night cover need not be changed.

2 Claims, 4 Drawing Sheets

REFRIGERATED DISPLAY CASE WITH NIGHT COVER

FIELD OF THE INVENTION

This invention relates to a refrigerated display case with a night cover and, more particularly, to a refrigerated display case with a night cover spacing member which allows the sliding door to be easily opened and closed.

BACKGROUND OF THE INVENTION

Horizontal display cases can be refrigerated and enclosed with a sliding glass door for adequate display function without significant cooling loss. At night, however, it is desirable to further insulate the display case door and opening to further minimize any loss of cooling within the case. To this end, an insulated cover is placed over the door and opening. This cover may be stored at some site remote from the display case or, more preferably, can be stored inside the display case but above the path of the sliding door.

A conventional refrigerated horizontal display case with a night cover is shown in FIG. 1. Refrigerated display case 1 includes cabinet 2 having at least one top opening 21, condensing unit area 3, sliding door 4, and top section 5. Condensing unit area 3 is disposed within cabinet 2 at its lower end portion. Sliding door 4 includes transparent glass 4*a*, frame member 4b which surrounds glass 4*a*, and pull 4*c* which is attached at the leading edge of frame member 4*b*. Door 4 is dimensioned to cover opening 21 although a plurality of doors may be used in combination if desired. Top section 5 is located at the upper rear portion of cabinet 2 to accommodate sliding door 4 and night cover 6 when opening 21 is not covered. Sliding door 4 slides on rigid guide rails 7 at both sides of cabinet 2 to open and close opening 21 as shown in FIG. 2. Night cover 6 is stored within the interior of top section 5 and is supported at its edges with supporting members 8 at both sides of cabinet 2. Night cover 6 is pulled down to cover sliding door 4 when the display case is to be covered for the night.

The conventional door-and-cover arrangement is generally satisfactory until sagging occurs at the center of night cover 6 as shown by the dotted line 6*a* in FIG. 2. This sagging can cause problems when sliding door 4 is opened to take out refrigerated articles: the sagging portion contacts the top of sliding door 4 and obstructs the sliding movement.

Two modifications might be considered to avoid obstruction of the sliding door by the night cover. One is to add reinforcing members to stiffen night cover 6. This, however, would increase the weight of night cover 6. The other modification would be to enlarge the distance between the stored night cover and the top of sliding door 4 to account for the distance of the sagging portion. Unfortunately, this would adversely affect the external appearance of display case 1.

It would be desirable to provide a display case having a sliding door and night cover that would not interfere with each other during movement of the sliding door but would continue to operate efficiently as a night cover.

SUMMARY OF THE INVENTION

It is an object of the invention to provide a refrigerated display case with a night cover and a sliding door which can be easily opened and closed. This and other objects will become apparent from the description herein.

A horizontal refrigerated display case according to the present invention includes a cabinet which is provided with at least one top opening. A sliding door is disposed on the cabinet to cover and uncover the top opening. A night cover is accommodated inside the cabinet and can be pulled across the sliding door to insulate the cabinet against warming. A spacing member is disposed on the trailing end of the sliding door frame to lift the night cover away from contact with the door.

The spacing member compensates for any sagging in the night cover and allows the sliding door to move under the cover without significant friction. Existing display cases can be easily modified without affecting the aesthetic design of the display case and without modifying the night cover.

DETAILED DESCRIPTION

Figure 1:
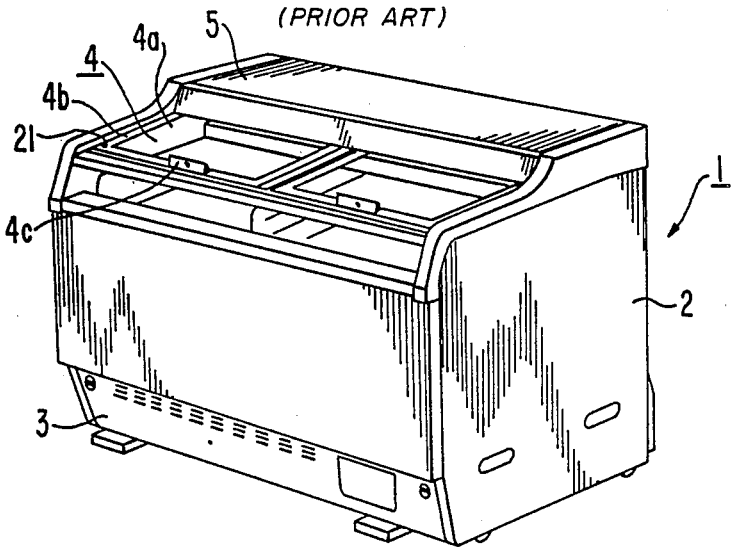
FIG. 1 (PRIOR ART)
FIG. 1 is a perspective view of a conventional refrigerated and cold display case.
Figure 4:
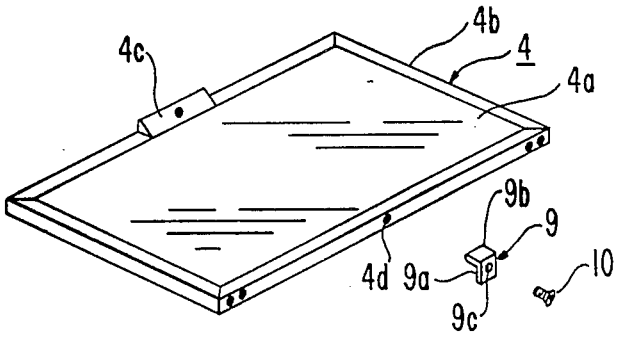
FIG. 4 is a perspective view of a sliding door on which a spacing member is attached at the trailing edge of the door frame.
Figure 2:
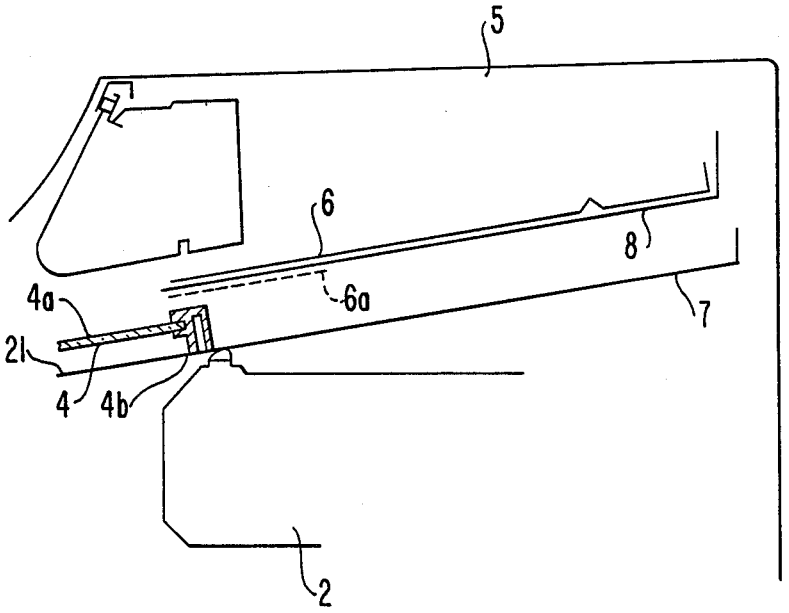
FIG. 2 (PRIOR ART)
FIG. 2 is a cross-sectional view of showing an interior of an upper plate as shown in FIG. 1.
Figure 3:
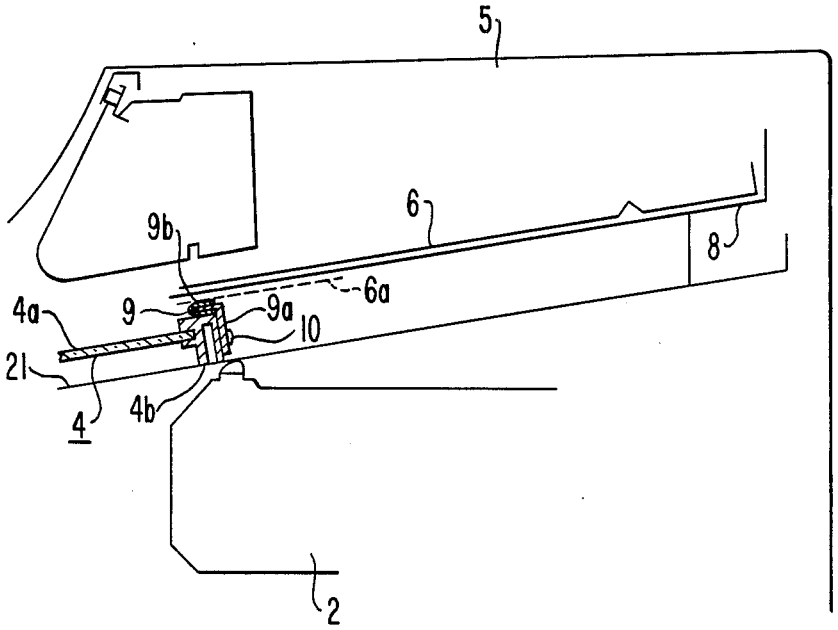
FIGS. 3 and 3*a* are cross-sectional views which show a spacing member attached to the trailing edge of a sliding door frame in accordance with one embodiment of the invention.
Figure 3A:
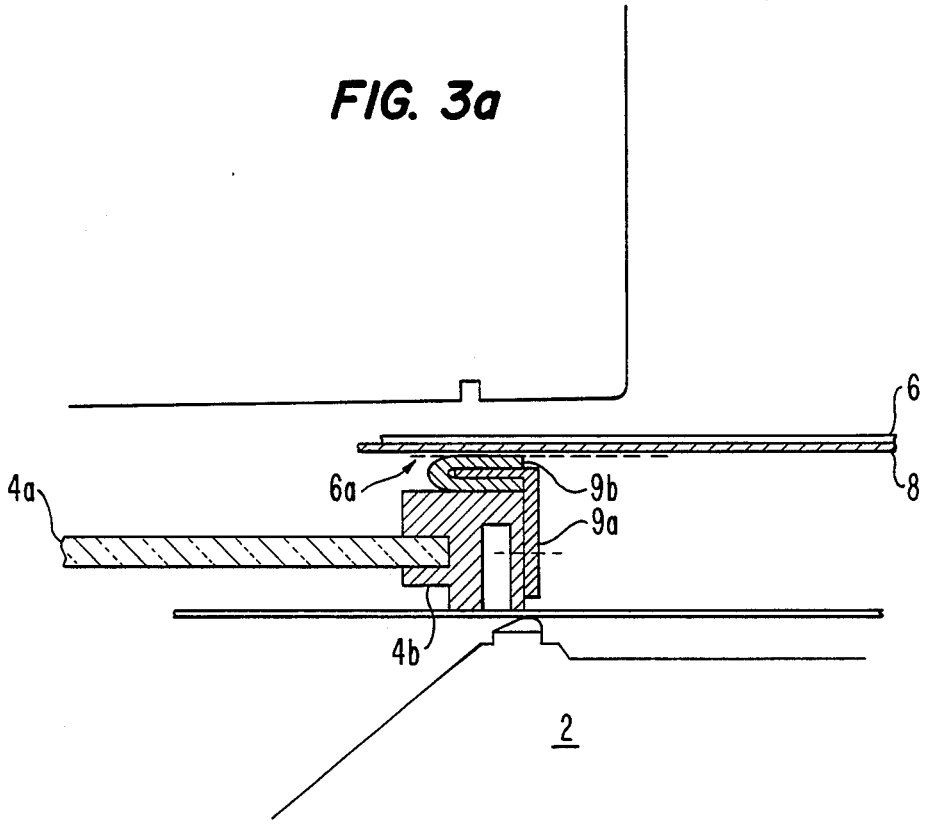

The reference numerals used in FIGS. 3, 3*a*, and 4 are the same as those used in FIGS. 1 and 2 when referring to the same elements.

Spacing member 9 includes attaching portion 9*a* and spacing portion 9*b*. Attaching portion 9*a* exhibits a configuration suitable for attachment to the trailing edge of frame member 4*b* by any suitable connecting means, e.g., a bolt, screw, rivet, weld, etc. FIG. 4 illustrates the use of screw 10 thru spacing member hole 9*c* and frame hole 4*d*. Spacing member 9 is preferably located on frame member 4*b* so that cover 6 extends over spacing portion 9*b* when door 4 closes opening 21 and cover 6 is fully inside top section 5.

Spacing portion 9*b* may exhibit a variety of different shapes and continue to fulfill the function of lifting the sagging portion of night cover away from door 4. Exemplary shapes are in the form of a "U", "J", "b", "C", and other smoothly curved shapes. Receiving portion 9*b* is preferably U-shaped in cross-section and is attached to or integral with attaching portion 9*a*.

Spacing member 9 may be made of virtually any material or any combination of materials. Wood, ceramics, plastic, and metal are only a few of the exemplary materials. The use of a stainless steel attaching portion 9*a* and plastic spacing portion 9*b*, e.g. polyacetal, are preferred.

When night cover 6 is located inside top section 5 and sliding door 4 is opened, spacing portion 9*b* contacts the sagging portion of cover 6 and lifts it away from door 4. The only friction that occurs when door 4 opens is between spacing portion 9*b* and cover 6 which represents a surface area much less than when the sagging portion of cover 6 contacts door 4. As a result, the sliding movement of door 4 is not signficantly hindered.

It should be understood that the depicted embodiments are merely illustrative of the invention, and the scope of the appended claims should not be limited to the depicted apparatus.

I claim:

1. In a refrigerated display case comprising a cabinet having a top opening, at least one sliding door dimensioned to cover and uncover at least a portion of said opening and disposed in a frame having a leading edge and a trailing edge, and a night cover disposed within said cabinet above said door, the improvement comprising:

a spacing member attached to the trailing edge of said frame member which compensates for any sagging in said night cover and spaces said night cover away from said door.

2. A display case according to claim 1 wherein said spacing member is U-shaped.

* * * * *